US009375714B2

(12) United States Patent
Fritchie et al.

(10) Patent No.: US 9,375,714 B2
(45) Date of Patent: Jun. 28, 2016

(54) CONTAINER HAVING GAS SCRUBBER INSERT FOR AUTOMATED CLINICAL ANALYZER

(75) Inventors: Patrick P. Fritchie, Southlake, TX (US); Gregory E. Gardner, Grapevine, TX (US)

(73) Assignee: Abbott Laboratories, Abbott Park, IL (US)

( * ) Notice: Subject to any disclaimer, the term of this patent is extended or adjusted under 35 U.S.C. 154(b) by 14 days.

(21) Appl. No.: 12/643,250

(22) Filed: Dec. 21, 2009

(65) Prior Publication Data

US 2011/0150704 A1 Jun. 23, 2011

(51) Int. Cl.
*B01L 3/00* (2006.01)

(52) U.S. Cl.
CPC ..... *B01L 3/523* (2013.01); *B01L 2200/16* (2013.01); *B01L 2300/044* (2013.01)

(58) Field of Classification Search
CPC .... B65D 51/30; B65D 51/244; B65D 81/266; Y02C 10/06; Y02C 10/08; B01D 46/0009; B01L 3/52; B01L 2200/16
USPC ..... 422/547, 550, 420; 206/204
See application file for complete search history.

(56) References Cited

U.S. PATENT DOCUMENTS

| | | | | |
|---|---|---|---|---|
| 3,892,549 | A | 7/1975 | Lyshkow | |
| 4,287,995 | A * | 9/1981 | Moriya | 215/228 |
| 5,610,073 | A | 3/1997 | Chu et al. | |
| 5,637,099 | A | 6/1997 | Durdin et al. | |
| 5,678,684 | A * | 10/1997 | Wright | 206/204 |
| 5,795,784 | A | 8/1998 | Arnquist et al. | |
| 5,856,194 | A | 1/1999 | Arnquist et al. | |
| 5,894,949 | A * | 4/1999 | Taskis et al. | 215/247 |
| 5,947,274 | A | 9/1999 | Taskis et al. | |
| 6,074,615 | A | 6/2000 | Lewis et al. | |
| 6,218,174 | B1 | 4/2001 | Keyser | |
| 6,361,744 | B1 * | 3/2002 | Levy | 422/570 |
| 6,555,062 | B1 | 4/2003 | Lewis et al. | |

(Continued)

FOREIGN PATENT DOCUMENTS

| | | |
|---|---|---|
| DE | 9006079 | 9/1990 |
| DE | 4222560 | 6/2000 |

(Continued)

OTHER PUBLICATIONS

Andrews, et al., Photodeactivation of Ethyl Violet: A Potential Hazard of Sodasorb®, Anesthesiology, 72:59-64, 1990.

(Continued)

*Primary Examiner* — Jill Warden
*Assistant Examiner* — Matthew Krcha
(74) *Attorney, Agent, or Firm* — Hanley, Flight & Zimmerman, LLC

(57) ABSTRACT

A device and method for extending the useful life of a liquid in a container used in an automated clinical analyzer. The liquid comprises a material subject to deterioration, the subject material capable of deteriorating as the result of reaction with a contaminant in a gas present in the atmospheric air surrounding the container. Atmospheric air surrounding the container that displaces the liquid consumed from a container is routed through a gas scrubber insert in order to remove or at least reduce the quantity of at least one contaminant present in that air. The gas scrubber insert is positioned between the liquid in the container and the atmospheric air surrounding the container.

32 Claims, 2 Drawing Sheets

(56) References Cited

U.S. PATENT DOCUMENTS

| | | | | |
|---|---|---|---|---|
| 7,329,307 | B2 | 2/2008 | Hrycak et al. | |
| 2003/0199095 | A1* | 10/2003 | Yuyama et al. | 436/1 |
| 2003/0223472 | A1 | 12/2003 | Ravalico et al. | |
| 2004/0052688 | A1* | 3/2004 | Adema et al. | 422/99 |
| 2005/0171489 | A1 | 8/2005 | Weaver et al. | |
| 2005/0279387 | A1 | 12/2005 | Blackwell et al. | |
| 2006/0118167 | A1 | 6/2006 | Neas et al. | |
| 2006/0263248 | A1 | 11/2006 | Gomm et al. | |
| 2007/0020629 | A1* | 1/2007 | Ross et al. | 435/6 |
| 2007/0034592 | A1 | 2/2007 | Pavlovic et al. | |
| 2009/0273121 | A1 | 11/2009 | Pavlovic et al. | |
| 2009/0282932 | A1 | 11/2009 | Blackwell et al. | |
| 2010/0034700 | A1 | 2/2010 | Rousseau et al. | |
| 2010/0107784 | A1 | 5/2010 | Stein | |
| 2012/0226243 | A1 | 9/2012 | Weaver et al. | |
| 2013/0226145 | A1 | 8/2013 | Weaver et al. | |
| 2014/0008321 | A1 | 1/2014 | Lentz et al. | |

FOREIGN PATENT DOCUMENTS

| | | | |
|---|---|---|---|
| EP | 766087 | B1 | 11/2004 |
| EP | 731355 | B1 | 10/2005 |
| GB | 2083622 | A | 3/1982 |
| JP | 2000009734 | | 1/2000 |
| JP | 2002544076 | | 12/2002 |
| JP | 2004506182 | | 2/2004 |
| JP | 2004157020 | | 3/2004 |
| JP | 2005324832 | | 11/2005 |
| JP | 2007292585 | | 11/2007 |
| JP | 2009196666 | | 9/2009 |
| WO | 9116242 | | 10/1991 |
| WO | 9604189 | | 2/1996 |
| WO | 0069389 | | 11/2000 |
| WO | WO-0128701 | A1 | 4/2001 |
| WO | WO-03062796 | A1 | 7/2003 |
| WO | WO-2004076034 | A1 | 9/2004 |
| WO | 2008009821 | | 1/2008 |
| WO | 2008130880 | | 10/2008 |
| WO | 2012112486 | | 8/2012 |

OTHER PUBLICATIONS

Engage™ 8407 Polyolefin Elastomer Dow Plastics. Datasheet [online]. 2008 [retrieved on Aug. 18, 2009]. Retrieved from the Internet: <URL:http://www.ides.com>.

Engage™ 8411 Polyolefin Elastomer Dow Plastics. Datasheet [online]. 2009 [retrieved on Aug. 18, 2009]. Retrieved from the Internet: <URL:http://www.ides.com>.

Notice for Reasons for Rejection, English Language, issued by the Intellectual Property Office of Japan, in connection with Japanese application No. 2012546012, on Jun. 10, 2014, 9 pages.

Australia Intellectual Property Office, "Notice of Acceptance," issued by the Australia Patent and Trademark Office in connection with application No. 2010340134, Aug. 2, 2013, 2 pages.

Notice of Rejection, issued by the Japan Patent Office in connection with Japanese application No. 2012-546012 on Jul. 23, 2013, 4 pages.

English Translation of Notice of Rejection, issued by the Japan Patent Office in connection with Japanese application No. 2012-546012 on Jul. 23, 2013, 5 pages.

English Translation of the Abstract of Japanese application No. 2004157020 published on Mar. 6, 2004, 1 page.

English Translation of the Abstract of Japanese application No. 2005324832 published on Nov. 24, 2005, 1 page.

English Translation of the Abstract of Japanese application No. 2000009734 published on Jan. 14, 2000, 1 page.

English Translation of the Abstract of Japanese application No. 2007292585 published on Nov. 8, 2007, 1 page.

Notification of the Second Office Action, issued by the State Intellectual Property Office of the P.R. China, in connection with Chinese Patent Application No. 201080064441.8, on Oct. 8, 2014, 14 pages.

Notification of the First Office Action, English language version, issued by the State Intellectual Property Office of the P.R. China, in connection with Chinese Patent Application No. 201080064441.8, on Feb. 8, 2014, 24 pages.

Canadian Intellectual Property Office, "Requisition in Accordance With Subsection 30(2) of the Patent Rules" issued in connection with application No. CA 2,784938, on Apr. 11, 2013, 2 pages.

International Searching Authority, International Preliminary Report on Patentability and Written Opinion issued for International Patent Application No. PCT/US2010059902 on Jun. 26, 2012, 7 pages.

Decision of Rejection, issued by the State Intellectual Property Office of the P.R. China, in connection with Chinese application No. 201080064441.8, on Feb. 12, 2015, 16 pages.

Notification of Reexamination, issued by the State Intellectual Property Office of the P.R. China, in connection with Chinese Patent Application No. 201080064441.8, on Oct. 29, 2015, 21 pages.

Reexamination Decision, issued by the State Intellectual Property Office of the P.R. China, in connection with Chinese Patent Application No. 201080064441.8, on Apr. 7, 2016, 25 pages.

* cited by examiner

CONTAINER HAVING GAS SCRUBBER INSERT FOR AUTOMATED CLINICAL ANALYZER

BACKGROUND OF THE INVENTION

1. Field of the Invention

This invention relates to treatment of contaminants in the environment so that they do not contaminate the liquid in a container, more particularly, a liquid to be used in an assay in an automated clinical analyzer.

2. Discussion of the Art

The members of the ARCHITECT® family of automated clinical analyzers, commercially available from Abbott Laboratories, require fluid handling systems that employ at least one sub-system for aspirating and dispensing samples and reagents, at least one sub-system for dispensing buffers, at least one sub-system for dispensing pre-trigger solutions and trigger solutions, and at least one sub-system for handling liquid waste.

Through aspiration processes, samples are moved from sample containers and assay reagents are moved from reagent containers for dispensing into reaction vessels. In addition, wash buffer is dispensed for priming and flushing. Trigger solutions and pre-trigger solutions are also dispensed into reaction vessels. Trigger solutions and pre-trigger solutions are normally stored on-board the automated clinical analyzers as bulk liquid reagents in relatively large containers.

Liquid reagents are typically aspirated from containers, such as, for example, bottles, and the volume of liquid reagent aspirated is displaced by air from the atmospheric air surrounding the container, through a vent. As a result, carbon dioxide, i.e., $CO_2$, from the atmospheric air surrounding the container is absorbed by and dissolved in the liquid reagent, and the pH of the liquid reagent is lowered. The stability of the liquid reagent when stored upon the automated clinical analyzer is approximately thirty days. Some liquid reagents become unstable after a storage period on an automated clinical analyzer of fewer than thirty days. After thirty days, or less, the amount of carbon dioxide absorbed by and dissolved in the liquid reagent lowers the pH of the liquid reagent to a level that results in adversely affecting results of an assay.

Normally, when liquid reagents are aspirated from a container, the volume of liquid reagent is displaced by atmospheric air surrounding the container, through the actuation of a septum. The septum is also used to minimize evaporation of the liquid reagent. In addition, because the septum is not completely impervious to air, some contamination occurs naturally. As a result, carbon dioxide, or oxygen, from the atmospheric air surrounding the container is absorbed and dissolved in the liquid reagent, thereby affecting the chemical composition of the reagent. For example, when carbon dioxide reacts with water, the pH of the resulting aqueous composition is lowered. Reagent containers can be overfilled with additional liquid reagent to counteract the effects of displacement of liquid reagent by atmospheric air surrounding the container.

FIG. 1 shows a container of the prior art. As shown in FIG. 1, a container 10 has fins 12 for facilitating agitation of the contents of the container 10. A septum 14 is inserted in the mouth 16 of the container 10. The tip 18 of a pipette is inserted through an opening 20 in the septum 14. A liquid reagent 22 is shown in the lower half of the container 10. Displacement air 24 contaminated with a contaminant gas, such as, for example, carbon dioxide, is shown in the upper half of the container 10.

EP 0 766 087 discloses a method for the detection of creatinine in which an aqueous solution containing creatinine is contacted with a dry reagent system containing an indicator for creatinine at a pH above about 11.5. The high pH is provided by a dry alkaline material upon its being hydrated by the aqueous fluid. The dry reagent is packaged with a material capable of absorbing carbon dioxide and at least some ambient water vapor. The carbon dioxide-absorbing material is provided in an amount sufficient to substantially inhibit the formation of carbonic acid in the area of the reagent system. This inhibition of the production of carbonic acid increases the shelf life of the creatinine-detecting device by reducing or eliminating the neutralization of the alkali reagent by carbonic acid formed in situ.

U.S. Pat. No. 6,218,174 discloses degassing by driving a gas-containing solution to sub-atmospheric pressure approximately equal to the solution vapor pressure, and maintaining the subatomic pressure not withstanding evolution of gas from the solution. This method may be accomplished using a vacuum tower arrangement whereby a column of gas-containing liquid is drawn to the maximum physically attainable height. So long as the vacuum is coupled to the liquid column above this height (generally on the order of 34 feet, depending on the ambient temperature and the composition of the liquid), the liquid will not be drawn into the vacuum, which creates a non-equilibrium region of extremely low pressure above the liquid that liberates dissolved gases.

U.S. Pat. No. 7,329,307 discloses a carbon dioxide removal system including a member having a first opening and a second opening to enable air flow and containing lithium hydroxide (LiOH) supported by the member and having an initial water content above an anhydrous level. U.S. Pat. No. 7,329,307 further discloses removal of carbon dioxide by including pre-hydrated LiOH adsorbent in a location having air flow with carbon dioxide. The carbon dioxide is removed with pre-hydrated LiOH adsorbent.

Accordingly, it is desired that the useful life of the liquid reagent be extended as much as possible, so that the entire contents of the container of the liquid reagent can be consumed prior to the date by which it has deteriorated excessively. It is further desired that the liquid reagent have a useful life of at least about thirty days, and preferably longer, after being exposed to atmospheric air surrounding the container. It is still further desired that the pH of the liquid reagent be maintained at the appropriate level for an extended period of time. It is further desired that the effect of contamination of liquid reagents by atmospheric air surrounding the container be reduced so that adverse effects on assay results will be reduced. It is still further desired that the need to overfill reagent containers with additional liquid reagent to counteract the effects of contamination by atmospheric air surrounding the container be eliminated.

SUMMARY OF THE INVENTION

This invention provides a device and method for extending the useful life of a liquid used in an automated clinical analyzer. The subject liquid comprises a material subject to deterioration, the subject material capable of deteriorating as the result of reaction with a contaminant in a gas present in the atmospheric air surrounding the container. The device comprises a container having a mouth, a septum inserted into the mouth of the container, the septum having an opening therein. The tip of a pipette can be inserted through an opening in the septum. Displacement air is routed past a gas scrubber insert, typically a carbon dioxide scrubber or an oxygen scrubber. The gas scrubber insert removes gas, e.g., carbon dioxide or oxygen, from the displacement air and prevents contamination of the liquid that is to be used in the automated clinical analyzer.

The gas scrubber insert for carbon dioxide can be filled with sodium hydroxide (NaOH) granules, which absorb the carbon dioxide in the air as the air passes the gas scrubber insert. The gas scrubber insert for oxygen can be filled with iron (Fe) powder, which absorbs the oxygen, as the air passes the gas scrubber insert.

The septum disclosed herein helps to increase the useful life and effectiveness of the gas scrubber insert. An air permeable membrane, typically a mesh, can be used to retain the gas scrubber material in the gas scrubber insert, while allowing atmospheric air surrounding the container to react with the gas scrubber material.

The gas scrubber insert is positioned between the liquid in the container and the atmospheric air surrounding the container. The gas scrubber insert contains a reagent that is capable of reacting with a contaminant in the atmospheric air surrounding the container, whereby a required characteristic(s) of the liquid in the container does (do) not change excessively prior to the date that the liquid is consumed. For example, if the contaminant is carbon dioxide gas, and the required characteristic of the liquid in the container is the level of pH of the liquid in the container, the reagent in the gas scrubber insert prevents the level of pH of the liquid in the container from changing excessively prior to the date that the liquid in the container is consumed.

Atmospheric air surrounding the container that displaces the liquid removed from a container is routed through the gas scrubber insert in order to remove or at least reduce the quantity of at least one contaminant present in that atmospheric air.

The gas scrubber insert described herein greatly reduces the quantity of gas absorbed by the liquid in the container and inhibits adverse effects on the liquid in the container, such as, for example, the lowering of the pH level of the liquid in the container. The useful life of the liquid in the container can be substantially extended by inhibiting the lowering of the pH value thereof. The effect of contamination by the atmospheric air surrounding the container on the liquid in the container and the adverse effect on assay results on account of the deterioration of the liquid in the container can be substantially reduced.

DETAILED DESCRIPTION

Figure 1:
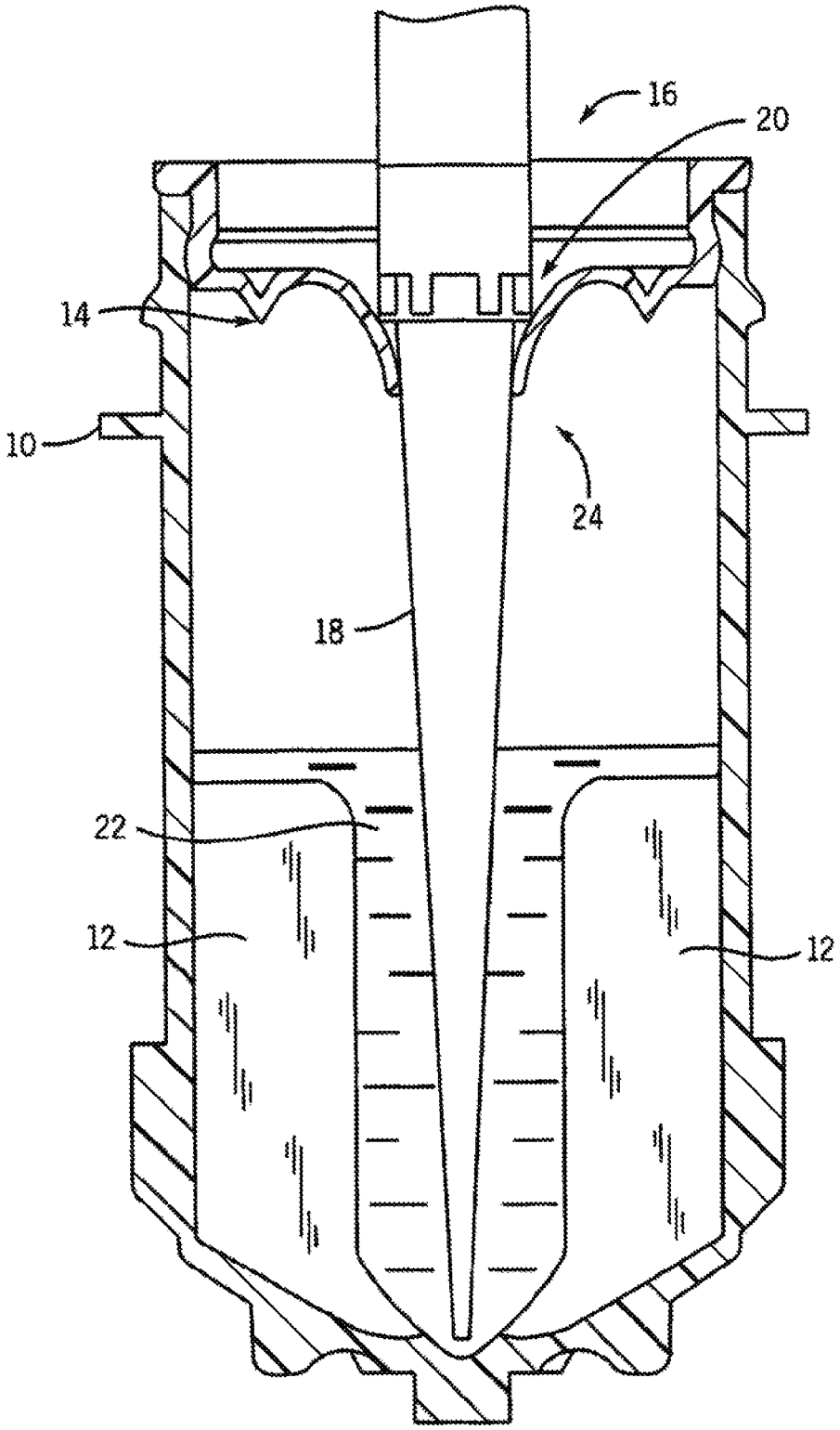
FIG. 1 (Prior Art)
FIG. 1 is a side view in elevation of a cross section of a conventional container of the prior art.

As used herein, the expression "automated clinical analyzer" means a medical laboratory instrument designed to measure different chemicals and other characteristics in a number of biological samples quickly, with minimal human assistance. These measured properties of blood and other fluids may be useful in the diagnosis of disease. Automated clinical analyzers include, but are not limited to, routine biochemistry analyzers, immuno-based analyzers, and hematology analyzers, such as, for example, cell counters, coagulometers. As used herein, the expression "automated clinical analyzer" means a clinical analyzer wherein involvement of an operator in the assay processing steps is minimal. As used herein, the expression, "on-board container" means a container that fits within the confines of the automated clinical analyzer and is capable of moving with the analyzer when the analyzer is moved.

As used herein, the term "fluid" means a substance, such as, for example, a liquid or a gas, that exists as a continuum marked by low resistance to flow and the tendency to assume the shape of its container. The fluids of primary concern with respect to the invention described herein are reagents in liquid form and atmospheric air. However, the term "fluid" also includes any fluid that is adversely affected by a contaminant that can be treated by a gas scrubber insert of the type described herein. Such fluids include, but are not limited to, liquid reagents, liquid samples, and liquid diluents. Accordingly, the term "liquid" includes, but is not limited to, liquid reagents, liquid samples, and liquid diluents. A liquid reagent is a reagent that exists in the form of a liquid or is suspended in a liquid carrier. A liquid sample is a sample that exists in the form of a liquid or is suspended in a liquid carrier. A liquid diluent is a diluent that exists in the form of a liquid or is suspended in a liquid carrier.

As used herein, the expression "displacement air" means air from the environment external to a system that displaces liquid from a container of liquid when the liquid is consumed during operation of the system. For example, when a quantity of a liquid reagent is withdrawn from a container to be used in the system, displacement air external to the system replaces the quantity of the liquid reagent withdrawn. As used herein, the expression "bulk liquid reagent" means liquid reagent that is provided in a container for a relatively large number of chemical reactions. For example, a trigger solution can be supplied as a bulk liquid reagent in a large container, wherein the container of trigger solution is expected to be used for approximately 3,000 tests. In general, a typical immunoassay for an ARCHITECT® automated immunoassay analyzer consumes approximately 300 microliters of the bulk liquid reagent. Because a low volume diagnostic laboratory rarely carries out 3,000 tests within a two-week period, the trigger solution supplied to a low-volume diagnostic laboratory is likely to deteriorate prior to its being completely consumed.

As used herein, the expression "atmospheric air" means the mixture of solids, liquids, and gases surrounding a container that contains a liquid that comprises a material subject to deterioration, such as, for example, a reagent, a sample, a diluent, the subject material capable of deteriorating as the result of reaction with a contaminant in a gas present in the atmospheric air surrounding the container. The gases in atmospheric air are classified as either permanent (i.e., the concentration of the gas remains constant) or variable (i.e., the concentration of the gas varies over a period of time). The permanent gases include oxygen, nitrogen, neon, argon, helium, and hydrogen. The most abundant of these permanent gases are nitrogen (about 78%) and oxygen (about 21%). The remainder of the permanent gases and the variable gases (including carbon dioxide) are present in small concentrations in atmospheric air. The gases present in small concentrations are referred to as trace gases. Atmospheric air also includes sulfur, chlorofluorocarbons, dust, and ice particles.

As used herein, the term "immunoassay" means a biochemical test that measures the concentration of a substance in a biological liquid, typically serum, using the reaction of an antibody (antibodies) to its (their) antigen. An immunoassay takes advantage of the specific binding of an antibody to its antigen. As used herein, a "chemiluminescent microparticle immunoassay", alternatively referred to as "chemiluminescent magnetic immunoassay", involves a chemiluminescent label conjugated to the antibody or the antigen. In one type of this assay, a magnetic microparticle is coated with antibodies.

The assay is intended to look for antigens in the sample. A second antibody is labeled with a chemiluminescent label. This second antibody is not attached to a magnetic microparticle. The antibody and antigen with attach in the following order: antibody on magnetic microparticle-antigen-antibody-chemiluminescent label. The magnetic microparticle is then washed off. The amount of antibody-antigen-enzyme is measured by adding pre-trigger solution and trigger solution and measuring the light produced. This type of immunoassay produces light when combined with its substrate, i.e., a specific binding member. The chemiluminescent reaction offers high sensitivity and ease of measurement. This type of immunoassay involves a noncompetitive sandwich format that yields results that are directly proportional to the amount of analyte present in the sample. Another type of this assay involves a competitive format, wherein an antigen and a labeled antigen are competing for the same antibody site, or an antibody and a labeled antibody are competing for the same antigen site. For example, a magnetic microparticle is coated with an antibody for a specific antigen. In addition, a reagent, which is a labeled antigen, is added. The labeled antigen and the unlabeled antigen compete for antibody sites of the magnetic microparticle. Only when the labeled antigen attaches to the antibody on the microparticle can light be produced via the chemiluminescent reaction. The amount of antigen in the original sample is indirectly proportional to the quantity of light produced. As used herein, the term "magnetic" means paramagnetic. The purpose of the pre-trigger solution is to enable the release of a chemiluminescent material, e.g., acridinium, from the conjugate that has bound to the magnetic microparticles in an immunoassay. In addition, the pre-trigger solution adds hydrogen peroxide and lowers the pH to a level so that no photons are emitted from the chemiluminescent material. A trigger solution complementary to the pre-trigger solution raises the pH back to neutral by means of a basic solution, e.g., sodium hydroxide solution, and allows the hydrogen peroxide to generate photons from the chemiluminescent material.

As used herein the term "contaminant" means an agent that renders a substance impure, whereby the impure nature of the substance adversely affects the functional characteristics of the substance. As used herein, the terms "epoxy", "epoxy resin", and the like, mean one of various, usually thermosetting resins, capable of forming tight cross-linked polymer structures marked by toughness, strong adhesion, and high corrosion and chemical resistance, used especially in adhesives and surface coatings.

Automated clinical analyzers that are contemplated for use with the system for the treatment of contaminants described herein include automated clinical chemistry analyzers and automated immunoassay analyzers, such as, for example, ARCHITECT® automated immunoassay analyzers, as modified to utilize the system for the treatment of contaminants described herein. A representative example of such an automated immunoassay analyzer that can be modified to utilize the system for the treatment of contaminants described herein is the ARCHITECT® i2000 automated immunoassay analyzer. This automated immunoassay analyzer is described, for example, in U.S. Pat. Nos. 5,795,784 and 5,856,194, both of which are incorporated herein by reference. U.S. Patent Application Publication Number 2006/0263248 A1, incorporated herein by reference, describes another automated immunoassay analyzer that can be adapted to use the liquid waste management system described herein. The system described in U.S. Patent Application Publication Number 2003/0223472 A1, incorporated herein by reference, can also be adapted to use the system for the treatment of contaminants described herein. In addition, the probe washing apparatus described in U.S. Patent Application Publication Number 2005/0279387 A1, incorporated herein by reference, can be adapted to use the system for the treatment of contaminants described herein. Still further, some of the sub-systems described in U.S. patent application Ser. No. 11/644,086, filed Dec. 22, 2006, incorporated herein by reference, can be adapted to use the system for the treatment of contaminants described herein.

Figure 2:
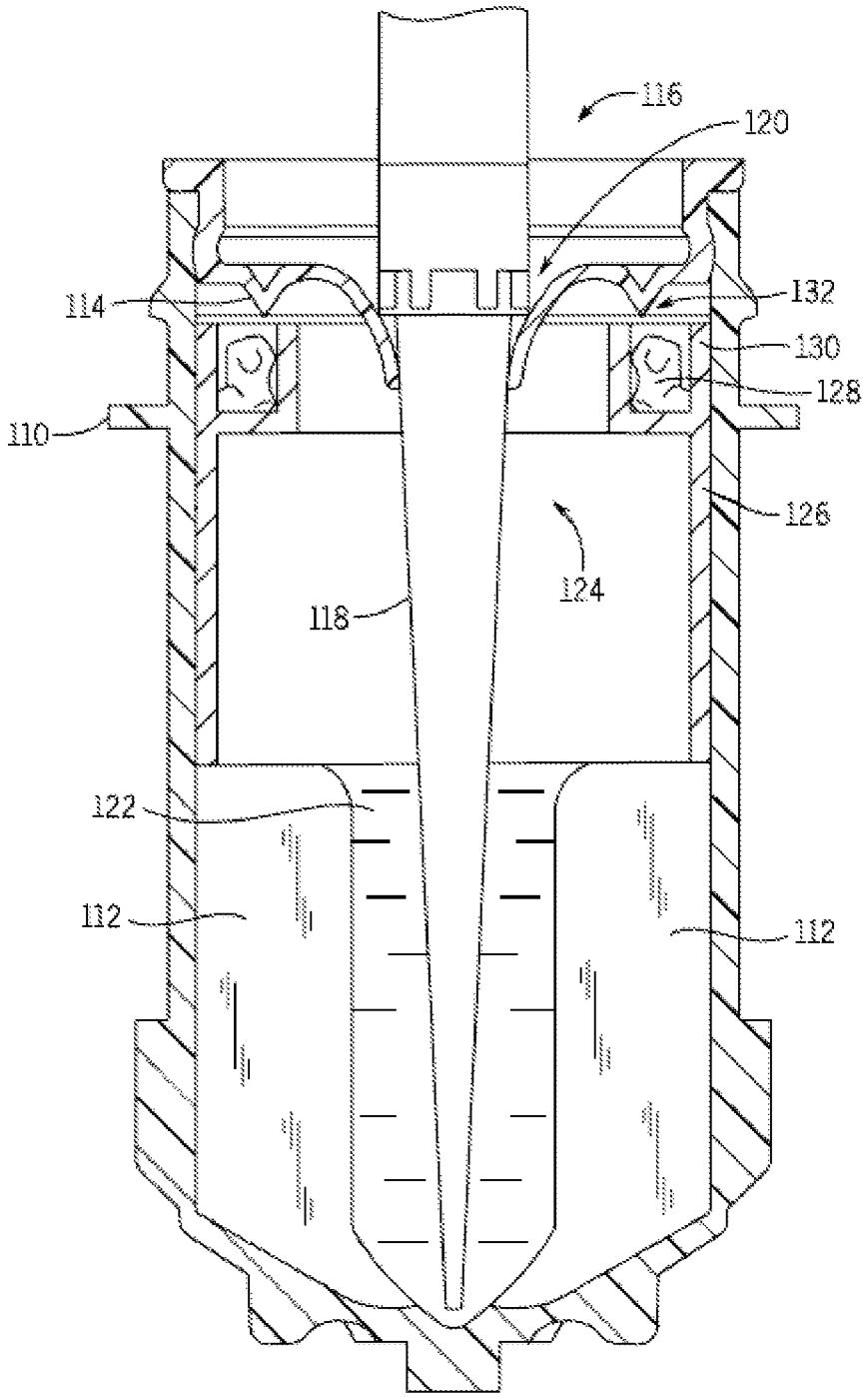
FIG. 2 is a side view in elevation of a cross section of a container for use in the invention described herein.

As shown in FIG. 2, a container 110 has fins 112 for facilitating agitation of the contents of the container 110. A septum 114 is inserted in the mouth 116 of the container 110. The tip 118 of a pipette is inserted through an opening 120 in the septum 114. A liquid reagent 122 is shown in the lower half of the container 110. Scrubbed displacement air 124 is shown in the upper half of the container 110.

Displacement air is routed past a gas scrubber insert 126, typically a carbon dioxide scrubber or an oxygen scrubber. The gas scrubber insert 126 contains a gas scrubber material 128 in a receptacle 130. The gas scrubber material 128 of gas scrubber insert 126 removes gas, e.g., carbon dioxide or oxygen, from the displacement air and prevents contamination effects on the liquid reagent. While it is stated that the container 110 contains a liquid reagent, the device described herein can also be used with containers that contain liquid samples, liquid diluents, or other liquids. The gas scrubber insert for carbon dioxide preferably contains sodium hydroxide (NaOH) granules, which absorb the carbon dioxide in the air as the air passes the gas scrubber material 128 of the gas scrubber insert 126. The gas scrubber insert for oxygen preferably contains with iron powder, which absorbs the oxygen in the air, as the air passes the gas scrubber material 128 of the gas scrubber insert 126. The septum 114 described herein helps to increase the useful life and effectiveness of the gas scrubber insert 126. An air permeable membrane 132, typically a mesh, can be used to retain the gas scrubber material 128 in the gas scrubber insert 126, while allowing surrounding air to react with the gas scrubber material 128.

The container 110 is capable of holding a liquid. The container 110 is also capable of receiving the tip 118 of a pipette or other aspirating/dispensing device. As indicated earlier, examples of liquids capable of being held by the container include liquid reagents, liquid samples, and liquid diluents. Containers 110 suitable for use with this invention include, but are not limited to, those described in U.S. Pat. Nos. 6,074,615 and 6,555,062, both of which are incorporated herein by reference. The container described in U.S. Pat. Nos. 6,074,615 and 6,555,062 includes a plurality of fins 112, which are generally used for agitating a solid phase reagent within the container in a manner described in U.S. Pat. Nos. 6,074,615 and 6,555,062.

The septum 114 is capable of being joined to the container 110 by means of friction fit. Representative materials that can be used for making septa include elastomers, polyolefins, such as, for example, ethylene-octene copolymers. Commercially available materials that can be used for making septa include polyolefin elastomers, such as, for example, Engage™ 8411 ethylene-octene elastomer, commercially available from Dow Plastics, Engage™ 8407 ethylene-octene copolymer, commercially available from Dow Plastics. These polyolefin elastomers are described in Engage™ 8411 Polyolefin Elastomer brochure, May 26, 2009, and Engage™ 8407 Polyolefin Elastomer brochure, Oct. 6, 2008, both of which are incorporated herein by reference. Typical dimensions for a septum suitable for use herein include the following: (a) outside diameter of 33 mm; slit for the opening having a length of 0.35 inch, thereby enabling the diameter of the opening to be 0.35 inch.

Typical dimensions of a tip 118 for a pipette or other aspirating/dispensing device are 100 mm long by 8 mm diameter, volume of from about 50 to about 1000 microliters. Typical materials for fabricating a tip 118 for a pipette or other aspirating/dispensing device include thermoplastic elastomer, such as, for example, PRE-ELEC TP 6735 polypropylene, PRE-ELEC TP 6735 polyethylene, both of which are commercially available from Premix Thermoplastics Inc., PO Box 188, 265 N Janesville St., Milton Wis. 53563.

Typical dimensions for a gas scrubber insert 126 suitable for use herein are as follows: inside diameter 0.54 inch; outside diameter 1.03 inch; height 0.86 inch. Materials that are suitable for fabricating a gas scrubber insert 126 include, but are not limited to, polypropylene, low density polyethylene. Gas scrubber materials 128 suitable for the active ingredient of the gas scrubber insert 126 include NaOH, which reacts with carbon dioxide, and iron, copper, aluminum, and other metals, which react with oxygen.

An air permeable membrane 132 for the gas scrubber insert 126, typically a mesh, can be formed from the same materials from which the gas scrubber insert 126 is formed. The air permeable membrane 132 has openings to optimize flow of air (e.g., openings of 0.050 inch in diameter).

Scrubber systems are a diverse group of air pollution control devices that can be used to remove particulates and/or gases from industrial exhaust streams. Traditionally, the term "scrubber" has referred to pollution control devices that used liquid to scrub unwanted pollutants from a gas stream. Recently, the term is also used to describe systems that inject a dry reagent or slurry into a dirty exhaust stream to scrub out acid gases. Scrubbers are one of the primary devices that control gaseous emissions, especially acid gases. Dry sorbent injection involves the addition of an alkaline material (usually hydrated lime or soda ash) into a gas stream to react with the acid gases. The sorbent can be injected directly into several different locations. The acid gases react with alkaline sorbents to form solid salts, which are removed in the particulate control device. These simple systems can achieve only limited acid gas removal efficiencies. Higher collection efficiencies can be achieved by exposing more surface area of the alkaline material to the acid gas. One side effect of scrubbing is that the process only removes the unwanted substance from the exhaust gases into a solid waste or powder form. If there is no useful purpose for this solid waste, it must be either contained or buried to prevent environmental contamination.

In the case of the unwanted contaminant carbon dioxide, a carbon dioxide scrubber is a container filled with particles of alkaline material, such as for example, sodium hydroxide (NaOH). As used herein, alkaline material means material having pH value in excess of 7.0. These particles absorb the carbon dioxide as the displacement air passes through the medium. The effectiveness of the scrubber is diminished as more of the particles of the accessible material undergo reaction with the contaminant. Replacement of the gas scrubber insert is unnecessary. The container, including the gas scrubber insert, can be discarded when the liquid reagent or other liquid, e.g., liquid sample, liquid diluent, has been partially or completely consumed. An indicator for indicating consumption of the scrubber material can be a visual indicator. A visual indicator suitable for use herein is a pH-sensitive dye, such as for example, Ethyl Violet.

Many varieties of gas scrubber materials 128 for carbon dioxide and oxygen are available. Some gas scrubber materials absorb both carbon dioxide and oxygen. The gas scrubber insert 126 can be provided in a reagent kit (not shown) within a sealed envelope (not shown). The gas scrubber insert 126 can be placed into the container 110, prior to installation of the septum 114 on the container 110. The installation of the gas scrubber insert 126 is simple. The gas scrubber insert 126 can be dropped into the container 110. The gas scrubber insert 126 can be designed in such a manner that it can be fitted or inserted into the container 110 in only a single orientation, thereby precluding improper positioning of the gas scrubber insert 126 in the container 110. The gas scrubber insert 126 is supported by the fins 112 in the container 110. The gas scrubber insert is expected to last the entire useful life of the liquid reagent, the liquid diluent, or the liquid sample, whatever the case may be. Accordingly, replacement via a routine maintenance cycle is not required. The gas scrubber insert can be constructed in a manner so as to provide a visual indication when the effectiveness of the gas scrubber insert 126 is reduced or when the gas scrubber material 128 is consumed. This color change could be useful when investigating issues related to liquid reagents, liquid diluents, or liquid samples.

Liquid reagents contemplated for use with the container described herein include, but are not limited to, liquid reagents containing solid microparticles suspended therein. Other liquids contemplated for use with the container described herein include, but are not limited to, assay specific diluents, specimen diluents, conjugates, and pretreatment agents.

Displacement air is routed through the gas scrubber insert, thereby removing unwanted contaminants from the displacement air and preventing the contaminants from contaminating the liquid reagent, the liquid diluent, or the liquid sample utilized in the automated clinical analyzer. Displacement air moves past a gas scrubber material for removing a gas, e.g., carbon dioxide or oxygen, whereby the gas, e.g., carbon dioxide or oxygen is removed from the displacement air and contamination of the liquid reagent, the liquid diluent, or the liquid sample is prevented. The gas scrubber insert for carbon dioxide can be filled with sodium hydroxide (NaOH) granules, which absorb the carbon dioxide in the air as the air passes the gas scrubber insert. In addition, the gas scrubber insert for oxygen can be filled with iron powder, which absorbs the oxygen, as the air passes the gas scrubber insert. The septum currently used is capable of helping to increase the useful life and effectiveness of the gas scrubber insert. An air permeable mesh can be used to retain the gas scrubber material in the gas scrubber insert, but allow surrounding air to react with the gas scrubber material. As indicated previously, atmospheric air contains 78.08% nitrogen, 20.95% oxygen, 0.93% argon, 0.038% carbon dioxide, trace amounts of other gases. Scrubbed air is substantially free of oxygen or carbon dioxide, depending on the requirement specified.

The container contains a liquid reagent, a liquid sample, or a liquid diluent, whatever the case may be, that reacts with at least one contaminant in the atmospheric air surrounding the container, whereby the liquid reagent, the liquid sample, or the liquid diluent is adversely affected by the contaminant in the atmospheric air surrounding the container. If the contaminant is an acidic contaminant, e.g., carbon dioxide gas, and if the liquid reagent, liquid sample, or liquid diluent is basic, i.e., having a pH value above 7.0, the gas scrubber insert should contain an alkaline material, e.g., sodium hydroxide.

In operation, as the liquid reagent, the liquid diluent, or the liquid sample is drawn from the container 104, typically by aspiration, and delivered to a sub-system of the automated clinical analyzer for dispensing liquid reagents, liquid diluents, or liquid samples, the liquid reagent, the liquid diluent, or the liquid sample drawn is replaced by displacement air.

The displacement air, the source of which is the atmospheric air surrounding the container, enters the system via the opening in the septum to displace the liquid reagent, the liquid diluent, or the liquid sample that is drawn from the container, then enters the gas scrubber insert, where the reagent in the gas scrubber insert reacts with the contaminant, e.g., carbon dioxide gas, in the atmospheric air, thereby preventing most of the contaminant, e.g., carbon dioxide gas, from entering the liquid in the container 104. Because the carbon dioxide gas does not enter the liquid in the container 104, the carbon dioxide does not react with the liquid reagent, the liquid diluent, or the liquid sample, whatever the case may be, with the result that the pH of the liquid reagent, the liquid diluent, or the liquid sample remains stable, i.e., at a pH greater than 7.0, for a relatively long period of time, e.g., as much as thirty days or more. Under current conditions, it is expected that a liquid reagent will be discarded after approximately thirty days. Thus, it can be seen that the stability of the liquid reagent can be extended to at least about thirty days and the effects of the atmospheric air surrounding the container can be greatly reduced.

The useful life of the gas scrubber material can be determined by the volume of air flowing through the scrubber, the concentration of the gas in the air, and how often a maintenance cycle would result in replacement of the gas scrubber insert.

The following factors can be used to determine the quantity of reagent to treat carbon dioxide gas ($CO_2$):

1. It is assumed that the volume of the container for the liquid reagent, the liquid sample, or the liquid diluent is approximately 30 mL (30 $cm^3$).

2. The concentration of carbon dioxide in the atmospheric air surrounding the container is approximately 365 parts per million (ppm).

3. A cubic meter contains 1,000,000 $cm^3$ of air or 40 moles of air, which contains 0.015 mole of carbon dioxide.

4. Each 30 mL volume of air that passes through the gas scrubber insert contains 0.00000045 ($4.5\times10^{-7}$) mole of carbon dioxide ($CO_2$).

5. The reaction of $CO_2$ and sodium hydroxide (NaOH) requires two molecules of NaOH to form $Na_2CO_3$ and $H_2O$. $9\times10^{-7}$ mole of NaOH is required for each 30 mL of air that passes through the gas scrubber insert.

6. Because the molecular weight of NaOH is 40 grams/mole, $1.8\times10^{-5}$ grams of NaOH per 30 mL of air that passes through the gas scrubber insert.

7. Estimating that the gas scrubber insert is 10% efficient, because (a) not all of the NaOH is exposed to the stream of air and (b) ten times the amount of displacement air passes through the septum because it is not air-tight, the gas scrubber insert would require 0.0018 gram of NaOH.

The quantities of sodium hydroxide or substitutes for sodium hydroxide, e.g., other alkaline materials that can react with carbon dioxide, can vary as a function of the desired useful life of the gas scrubber insert. A greater quantity of alkaline material provides a longer life to the gas scrubber insert. Representative examples of materials that can be used in a gas scrubber insert for carbon dioxide gas ($CO_2$) include, but are not limited to, sodium hydroxide, lithium hydroxide, potassium hydroxide, calcium hydroxide, and other bases that react readily with carbon dioxide.

The following factors can be used to determine the quantity of reagent to treat oxygen gas ($O_2$):

1. It is assumed that the volume of the container for the liquid reagent, the liquid sample, or the liquid diluent is approximately 30 mL (30 $cm^3$).

2. The concentration of oxygen in the atmospheric air surrounding the container is approximately 210,000 parts per million (ppm).

3. A cubic meter contains 1,000,000 $cm^3$ of air or 40 moles of air, which contains 8.4 moles of oxygen.

4. Each 30 mL volume of air that passes through the gas scrubber insert contains 0.00025 ($2.5\times10^{-4}$) mole of oxygen.

5. The reaction of three molecules of oxygen ($O_2$) requires four molecules of iron (Fe) to form two molecules of $Fe_2O_3$. $3.3\times10^{-4}$ mole of iron is required for each 30 mL of air that passes by the gas scrubber insert.

6. Because the molecular weight of iron is 56 grams/mole, $1.8\times10^{-2}$ gram of iron per 30 mL of air is required for displacing the liquid in the container.

7. Estimating that the gas scrubber insert is 10% efficient, because (a) not all of the Fe is exposed to the stream of air and (b) ten times the amount of displacement air passes through the septum because it is not air-tight, 1.8 grams of iron are required.

The quantities of iron or substitutes for iron, e.g., other metallic materials that can react with oxygen, can vary as a function of the desired useful life of the gas scrubber insert. A greater quantity of metallic material provides a longer life to the gas scrubber insert. Representative examples of materials that can be used in a gas scrubber insert for oxygen gas ($O_2$) include, but are not limited to, iron, copper, aluminum, and other metallic elements that react readily with oxygen.

The gas scrubber insert described herein can be used with any liquid transfer system in which atmospheric air displaces the liquid removed from a container, wherein the liquid in the container is affected by specific gases in the atmospheric air surrounding the container. For example, if a liquid reagent, a liquid diluent, or a liquid sample is affected by oxygen gas ($O_2$), instead of carbon dioxide gas ($CO_2$), an oxygen gas ($O_2$) scrubber insert can be used.

The device described herein enhances the stability of a liquid reagent, a liquid diluent, or a liquid sample, whatever the case may be, so that the useful life of the liquid reagent, the liquid diluent, or the liquid sample can be extended, whereby the liquid reagent, the liquid diluent, or the liquid sample is likely to be completely consumed prior to its expiration date. Such an extension eliminates waste, is friendly to the environment, and improves customer satisfaction. Furthermore, the device described herein can be used with any container for liquids wherein atmospheric air surrounding the container displaces the liquid removed from the container and specific gases in the atmospheric air surrounding the container adversely affects the liquid remaining in the container. Other methods for controlling contamination by gases present in atmospheric air surrounding the container would require complex, and consequently expensive, environmental envelopes placed around areas where liquid reagents, liquid diluents, or liquid samples are stored. Improved septa could result in insertion forces and extraction forces beyond the capability of aspirating/dispensing devices. In addition, the method of overfilling reagent containers to account for reduction in activity of contaminated reagents would no longer be necessary.

The various components mentioned and described herein, such as, for example, containers, end caps, trays, fluid lines, conduits, connectors, electrical wires, fittings, valves, pumps, sensors, fastening components, reagents, automated clinical analyzers and the individual components thereof, are commercially available from numerous sources.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An apparatus comprising:

a container to hold a liquid comprising a material subject to deterioration as the result of reaction with a contaminant in a gas present in atmospheric air surrounding the container, said container having a mouth;

a septum removably insertable in said mouth, said septum having an opening therein; and a gas scrubber insert removably disposable in the container and separately supported from the septum in the container, the gas scrubber insert including a receptacle containing a reagent, the gas scrubber insert having a top end and a bottom end, the top end being spaced below a bottom surface of the septum when the gas scrubber insert is disposed in the container.

2. The apparatus of claim 1, wherein the reagent is to react with the contaminant to inhibit a lowering of a pH value of the liquid.

3. The apparatus of claim 2, wherein the reagent is an alkaline material.

4. The apparatus of claim 3, wherein the alkaline material is one or more of sodium hydroxide, lithium hydroxide, potassium hydroxide or calcium hydroxide.

5. The apparatus of claim 2, wherein the reagent is a metal.

6. The apparatus of claim 5, wherein the metal is one or more of iron, copper or aluminum.

7. The apparatus of claim 1 further including a gas permeable mesh disposed on the top end of the gas scrubber insert.

8. The apparatus of claim 7, wherein the gas permeable mesh is located between the top end of the gas scrubber insert and the bottom surface of the septum when the gas scrubber insert is disposed in the container.

9. The apparatus of claim 1, wherein said gas scrubber insert further includes an indicator to indicate consumption of a scrubber material.

10. The apparatus of claim 9, wherein said indicator is a visual indicator.

11. The apparatus of claim 9, wherein the indicator is a pH-sensitive dye.

12. The apparatus of claim 1 further including one or more of a liquid reagent, a liquid diluent, or a liquid sample disposed in the container.

13. The apparatus of claim 1, wherein the container comprises a plurality of fins to support the gas scrubber insert.

14. The apparatus of claim 13, wherein the plurality of fins support the gas scrubber insert from the bottom end of the gas scrubber insert.

15. The apparatus of claim 1, wherein the reagent is to react with the contaminant to inhibit a raising of a pH value of the liquid.

16. The apparatus of claim 1, wherein the gas scrubber insert is disposed below the mouth.

17. The apparatus of claim 1, wherein the gas scrubber insert has a diameter less than a diameter of the container.

18. The apparatus of claim 1, wherein a center of the septum is disposed above the gas scrubber insert.

19. The apparatus of claim 1, wherein the receptacle is disposed adjacent the top end of the gas scrubber insert.

20. The apparatus of claim 19, wherein the receptacle defines a channel having an opening, the reagent disposed within the channel and exposed to the gas in the container via the opening, the opening of the channel facing toward the bottom surface of the septum.

21. The apparatus of claim 20 further including a gas permeable mesh disposed on the top end of the gas scrubber and covering the opening of the channel.

22. The apparatus of claim 1, wherein the gas scrubber insert is separate from the septum.

23. The apparatus of claim 1, wherein the gas scrubber insert includes:

a sleeve forming a first wall; and a second wall coupled to the first wall, the second wall inward of the first wall, the receptacle formed between the first wall and the second wall.

24. A container comprising:

a first opening;

a gas scrubber comprising a sleeve having a first end and a second end forming a second opening therethrough and a circumferential receptacle coupled to the sleeve adjacent the first end, the gas scrubber disposed in the first opening; and a septum disposed in the first opening and having an extension disposable into the second opening, the gas scrubber separately supported from the septum in the container.

25. The container of claim 24, wherein the container comprises fins to support the gas scrubber.

26. The container of claim 24, wherein the gas scrubber has a reagent to react with a contaminant in the container.

27. The container of claim 26, wherein the reagent is disposed within the circumferential receptacle of the gas scrubber.

28. The container of claim 26, wherein the reagent is one of an alkaline material or a metal.

29. The container of claim 24, wherein the extension is disposed into the second opening when a pipette engages the septum and the extension is not disposed into the second opening when the pipette does not engage the septum.

30. The container of claim 24, wherein the first end of the gas scrubber is spaced from a bottom surface of the septum.

31. The container of claim 30, wherein the receptacle defines a channel having an opening to receive a reagent, the opening facing toward the bottom surface of the septum.

32. The container of claim 24, wherein the gas scrubber and the septum are separately disposable into the first opening.

* * * * *